US007112089B1

(12) United States Patent
Liu et al.

(10) Patent No.: US 7,112,089 B1
(45) Date of Patent: Sep. 26, 2006

(54) CONNECTOR FOR FLEXIBLE PRINTED CIRCUIT

(75) Inventors: Tian-Hong Liu, Kunshan (CN); Ren-Chih Li, Taipei (TW); Chi Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/168,157

(22) Filed: Jun. 27, 2005

(51) Int. Cl.
*H01R 12/24* (2006.01)

(52) U.S. Cl. ..... 439/495

(58) Field of Classification Search ..... 439/495, 439/260

See application file for complete search history.

(56) References Cited

U.S. PATENT DOCUMENTS 5,308,262 A * 5/1994 Chishima ..... 439/495
5,474,468 A * 12/1995 Chishima et al. ..... 439/495
5,562,487 A * 10/1996 Ii et al. ..... 439/495
5,688,143 A * 11/1997 McHugh et al. ..... 439/495
5,727,968 A * 3/1998 Ito ..... 439/495
5,816,845 A * 10/1998 Chishima et al. ..... 439/495
5,904,589 A * 5/1999 Asakawa ..... 439/495
5,934,932 A * 8/1999 Ito ..... 439/495
6,004,156 A * 12/1999 Roque et al. ..... 439/495
6,231,378 B1 * 5/2001 Wu et al. ..... 439/495
6,250,966 B1 * 6/2001 Hashimoto et al. ..... 439/631
6,276,958 B1 * 8/2001 Chih ..... 439/495
6,280,240 B1 * 8/2001 Chang ..... 439/495
6,315,602 B1 * 11/2001 Miura et al. ..... 439/495
6,315,603 B1 * 11/2001 Miura et al. ..... 439/495
6,319,052 B1 * 11/2001 Chang ..... 439/495
6,371,797 B1 * 4/2002 Kikuchi et al. ..... 439/496
6,386,905 B1 * 5/2002 Ito ..... 439/495
6,394,838 B1 * 5/2002 Yen ..... 439/492
6,475,025 B1 * 11/2002 Inoue ..... 439/495
6,475,026 B1 * 11/2002 Tseng et al. ..... 439/495
6,508,662 B1 * 1/2003 Yu ..... 439/498
6,551,128 B1 * 4/2003 Asai ..... 439/495
6,561,843 B1 * 5/2003 Ma et al. ..... 439/495
6,589,068 B1 * 7/2003 Yu ..... 439/495
6,619,979 B1 * 9/2003 Yu-Feng ..... 439/495
6,790,073 B1 * 9/2004 Wu ..... 439/495
6,939,166 B1 * 9/2005 Chung ..... 439/495
2002/0013086 A1 * 1/2002 Inoue ..... 439/495
2003/0082946 A1 * 5/2003 Miyazawa et al. ..... 439/495
2003/0096530 A1 * 5/2003 Ma et al. ..... 439/495
2003/0104721 A1 * 6/2003 Yu ..... 439/495
2004/0067679 A1 * 4/2004 Maejima ..... 439/495
2005/0118861 A1 * 6/2005 Chung ..... 439/495
2005/0124210 A1 * 6/2005 Zhang et al. ..... 439/495

* cited by examiner

*Primary Examiner*—Ross Gushi
(74) *Attorney, Agent, or Firm*—Wei Te Chung

(57) ABSTRACT

An electrical connector (100) includes a housing (1) defining a cavity (11) opened to a front face (10) thereof and a pair of recessed areas (14) on two side thereof; a plurality of terminals (2) disposed in the housing and with engagement portions (22) extending into the cavity; an actuator (3) movably assembled to the housing, said actuator including an elongated base (31), a tongue (32) extending from a middle section of the base and movable within the cavity, and a pair of side latches (33) respectively extending from end sections of the base and respectively disposed in the corresponding recessed areas; and a pair of locking ears (4) respectively assembled to an exterior side of the corresponding recessed area of the housing to define a guiding passageway together with the housing for guiding the movement of the side latch in the recessed area.

13 Claims, 8 Drawing Sheets

CONNECTOR FOR FLEXIBLE PRINTED CIRCUIT

BACKGROUND OF THE INVENTION

1. Field of the Invention

The present invention relates to an electrical connector, and more particularly to an electrical connector for a sheet-like connection member such as a flexible printed circuit or cable (FPC), a flexible flat cable (FFC) and so forth. All of these cables and circuit will be generally referred to as "FPC".

2. Description of Related Art

A conventional FPC connectors generally includes a housing defining a cavity opened to a front face thereof, a plurality of terminals loaded in the housing and extending into the cavity, and an actuator assembled to the housing and movable between an open position and a close position relative to the housing. The actuator generally has a tongue insertable into the cavity, which will carry the FPC disposed thereon into the cavity and then hold the FPC in contact with the terminals. The actuator usually further comprises a pair of side latches oppositely beside the tongue to engage with the housing for guiding the relative movement between the actuator and the housing and further for retaining the actuator on the housing at the closed position.

U.S. Pat. No. 6,004,156 discloses a flexible flat connector including a housing retaining a plurality of terminals therein and an actuator detachably assembled to the housing and movable between an open position and a closed position relative to the housing. The actuator has a pair of side latches each with an inwardly extending barb formed on a free end thereof. The side latches are guidingly and movably received in guide slots defined in opposite distal ends of the housing for guiding a relative movement between the actuator and the housing. A projection is formed in each guide slot for engaging with the barb of the corresponding side latch to retain the actuator at the closed position. However, as the guide slots are sidewardly opened and there is no stopper to prevent the side latch from the sidewardly tilting, once a push/pull force deflected from the push/pull direction is put to move the actuator by an unintentional and improper operation, it will cause the actuator to laterally tilt. For example, when the actuator is pulled forwardly from the closed position to the open position, it may occurs that one of the barbs of the latches is pulled over the projection in the guide slot but the other is still remained behind the projection. That will cause the actuator to split at some week point thereof and then the actuator will be destroyed.

Therefore, an improved FPC connector is desired to overcome the disadvantages of the prior arts.

SUMMARY OF THE INVENTION

An object of the present invention is to provide an FPC connector in which an actuator is prevented from being improper and destructive pulled/pushed and therefore can perform a smooth movement relative to the housing.

In order to achieve above-mentioned object, an FPC connector in accordance with a preferred embodiment of the present invention includes an insulative housing defining a cavity opened to a front face thereof and a pair of recessed areas on two side thereof; a plurality of terminals disposed in the housing and with engagement portions extending into the cavity; an actuator movably assembled to the housing, said actuator including an elongated base, a tongue extending from a middle section of the base and movable within the cavity, and a pair of side latches respectively extending from end sections of the base and respectively disposed in the corresponding recessed areas; and a pair of locking ears respectively assembled to an exterior side of the corresponding recessed area of the housing to define a guiding passageway together with the housing for guiding the movement of the side latch in the recessed area.

Other objects, advantages and novel features of the present invention will become more apparent from the following detailed description of the present embodiment when taken in conjunction with the accompanying drawings.

DETAILED DESCRIPTION OF THE INVENTION

Figure 1:
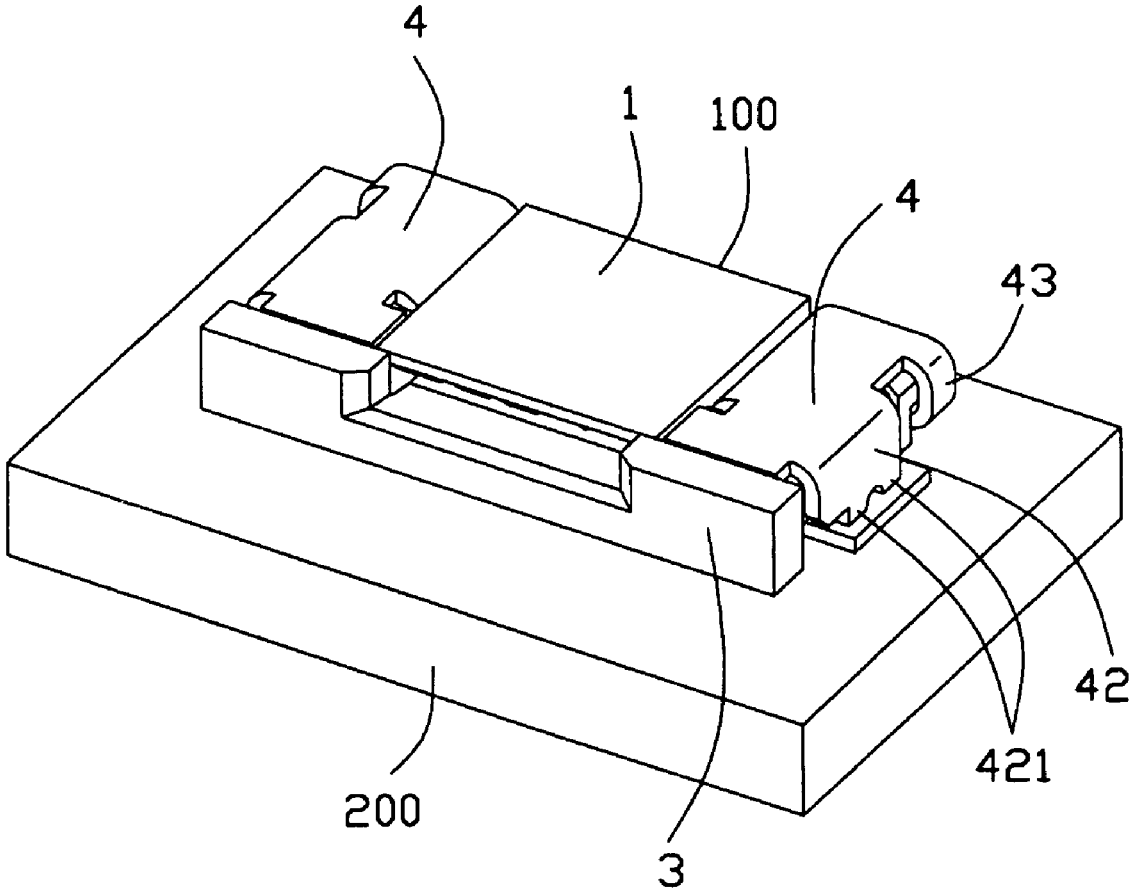
FIG. 1 is an assembled perspective view of an FPC connector mounted on a printed circuit board (PCB) in accordance with the preferred embodiment of the present invention.

Reference will now be made to the drawing figures to describe the preferred embodiment of the present invention in detail.

Referring to FIGS. 1–4, an FPC connector 100 for connecting an FPC to a printed circuit board (PCB) 200 in accordance with the present invention comprises an insulative housing 1, a plurality of terminals 2 loaded in the housing 1, an actuator 3 detachably assembled to the housing 1, and a pair of locking ears 4.

Figure 2:
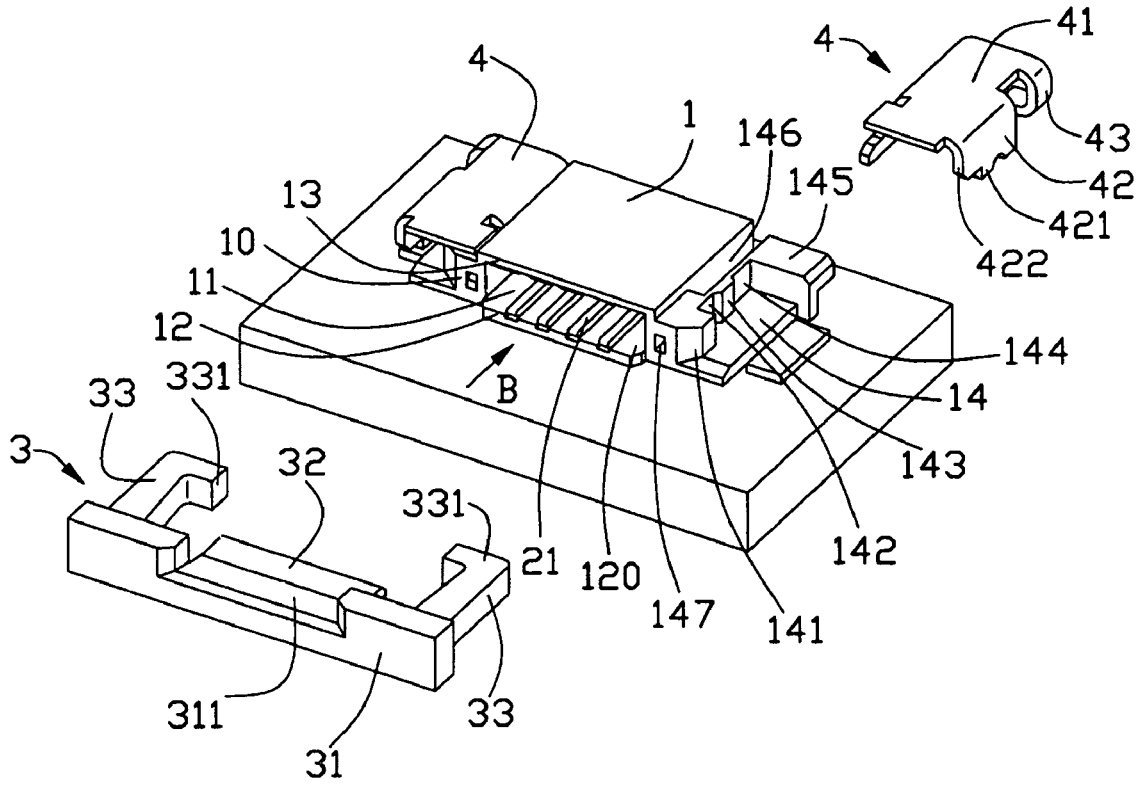
FIG. 2 is a partly exploded, perspective view of the FPC connector mounted on the PCB shown in FIG. 1, wherein an actuator and one of locking ears are detached from a housing thereof.
Figure 4:
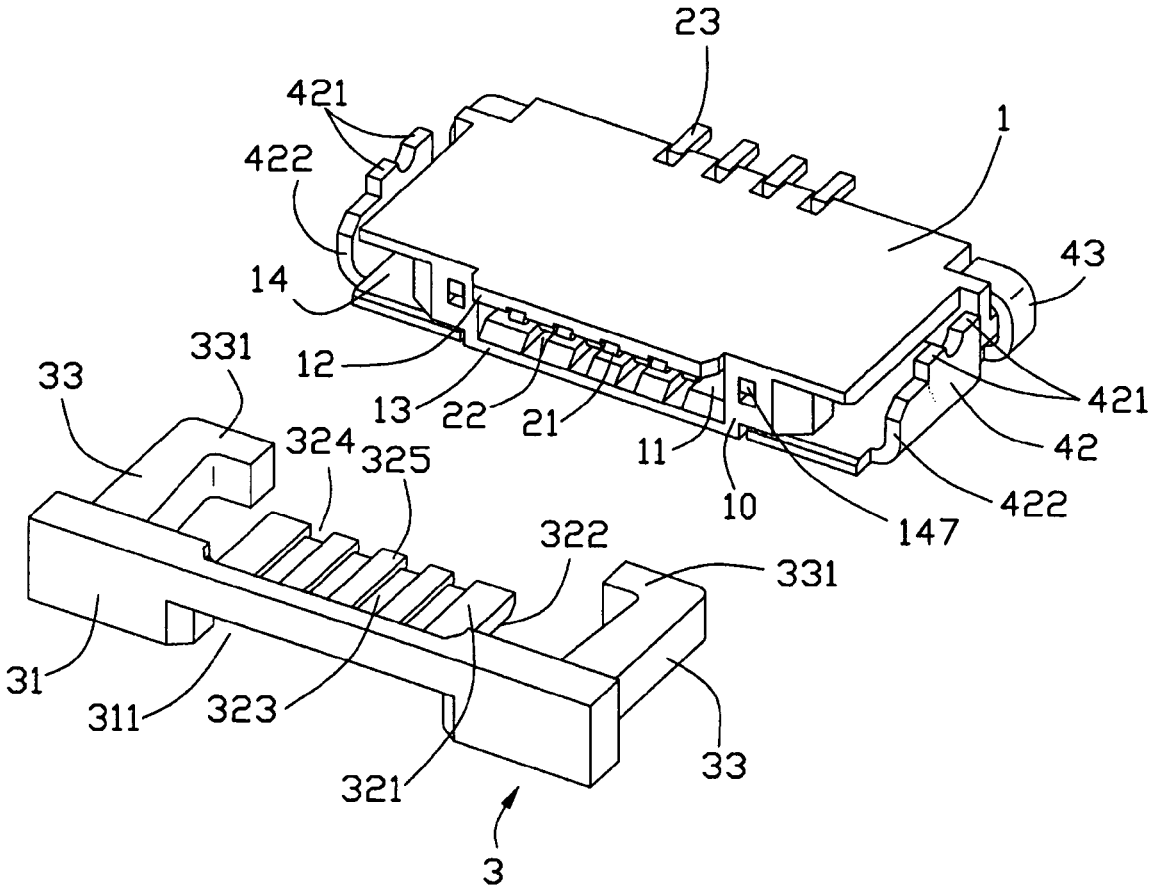
FIG. 4 is a view similar to FIG. 3 but taken from another aspect, wherein the PCB is removed.

The housing 1 comprises a middle portion formed with a lower wall 12 and an upper wall 13 which define a cavity 11 therebetween and a pair of side portions each defining an upwards and sidewards opened recess 14. The cavity 11 is opened to a front face 10 of the housing 1 for receiving the actuator 3 and an FPC (not shown). A front-to-back direction perpendicular to the front face 10, along which the FPC is inserted into the cavity 11, is defined as an insertion direction B. The lower wall 12 has a front end 120 extending forwards beyond a front edge of the upper wall 13 and therefore exposed to exterior out of the cavity 11, as best shown in FIGS. 2 and 4. Each of the recess 14 is configured with a front tuber 141, a middle tuber 143 and a back block 145, wherein the front tuber 141 and the middle tuber 143 define a first gap 142 therebetween, and the middle tuber 143 and the back block 145 define a second gap 144 therebetween.

Figure 7:
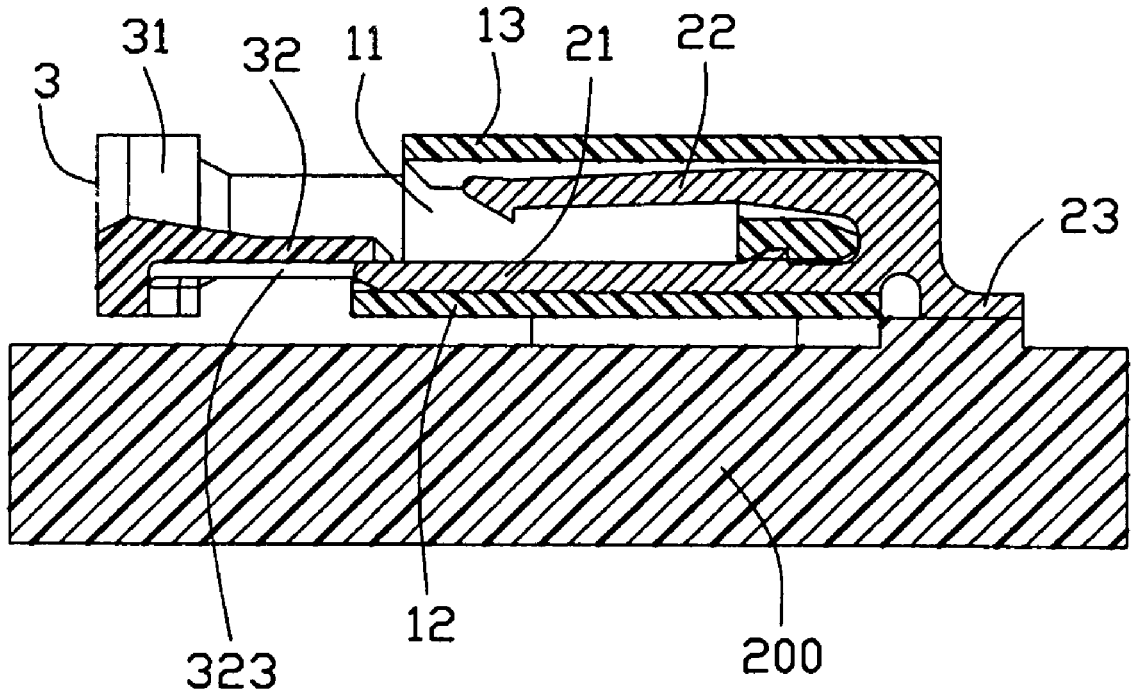
FIG. 7 is a cross-sectional view of FIG. 6 taken along line 7—7.

Referring to FIG. 7, the terminals 2 are inserted into the cavity 11 from a rear portion of the housing 1. Each terminal 2 comprises a fixed arm 21 extending oppositely along the insertion direction B and fixed in the lower wall 12, and a resilient arm 22 extending parallel to the fixed arm 21 and received in the upper wall 13 with a barbed free end thereof protruding into the cavity 11. In addition, there is a solder tail 23 extending beyond the housing 1 from the joint of the fixed arm 21 and the resilient arm 22 of each terminal 2 for being soldered to the PCB 200.

Figure 3:
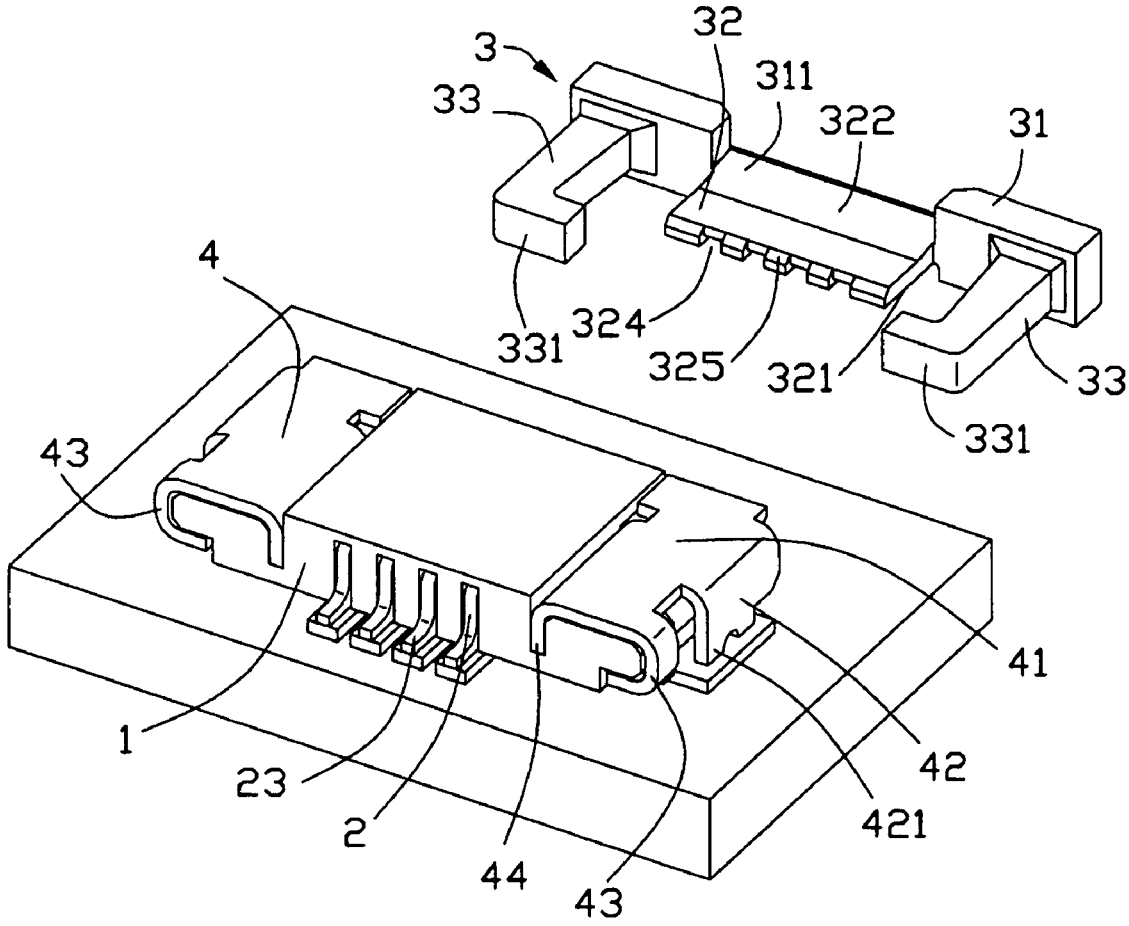
FIG. 3 is another partly exploded, perspective view of the FPC connector mounted on the PCB shown in FIG. 1, wherein the actuator is detached from the housing but both the two locking ears are still assembled on the housing.
Figure 5:
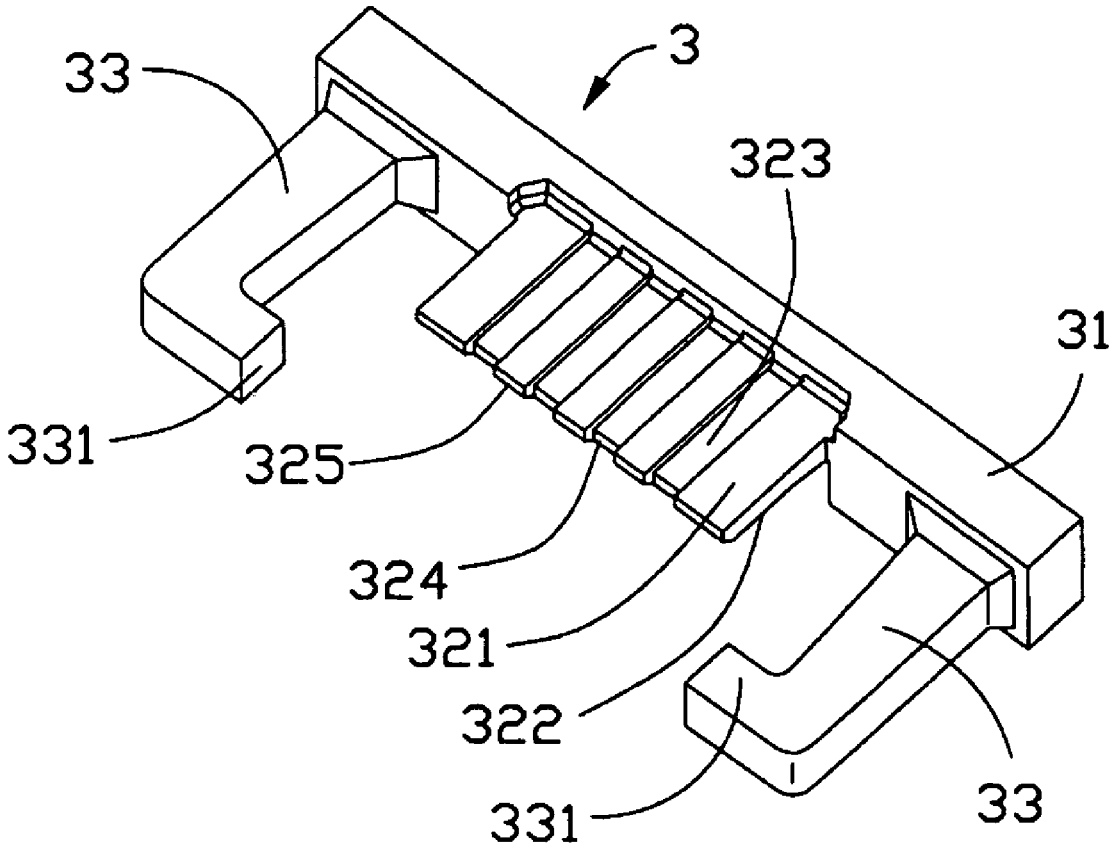
FIG. 5 is a perspective view singly showing the actuator of the FPC connector of FIG. 1.

Referring to FIGS. 3 and 5, the actuator 3 comprises an elongated base 31 defining a cutout 311 in a middle section thereof, a tongue 32 flush extending forwards from a bottom of the cutout 311, and a pair of side latches 33 extending forwards from two opposite end sections of the base 31. Each latch 33 has an inwardly protruding barb 331 at a free end thereof. The tongue 32 has an upper surface 322 inclined at a front end thereof and an under surface 321 defining a plurality of slots 323 corresponding to the fixed arms 21 of the terminals 2. The slot 323 extends upwards through the upper surface 322 at the front end of the tongue 32 to form a cutout 324 which gives birth to a pair of tips 325 therebeside accordingly. Thus the tongue 32 is provided with a comb-like shape at its front end, which is formed by an alternation of the cutouts 324 and the tips 325.

Referring to FIGS. 2, 4, 6 and 7, the actuator 3 is assembled to the housing 1 from an upside of the housing 1 with the barb 331 thereof vertically inserted into the first gap 142 without putting pressure on the housing 1. After the barb 311 received in the first gap 142, the actuator 3 is in an open position relative to the housing 1 to receive the FPC, while the end section of the tongue 32 abuts on the front end 120 of the lower wall 12 of the housing 1 and front sections of the fixed arms 21 received in the slots 323 on under surface 321 of the tongue 32.

Figure 6:
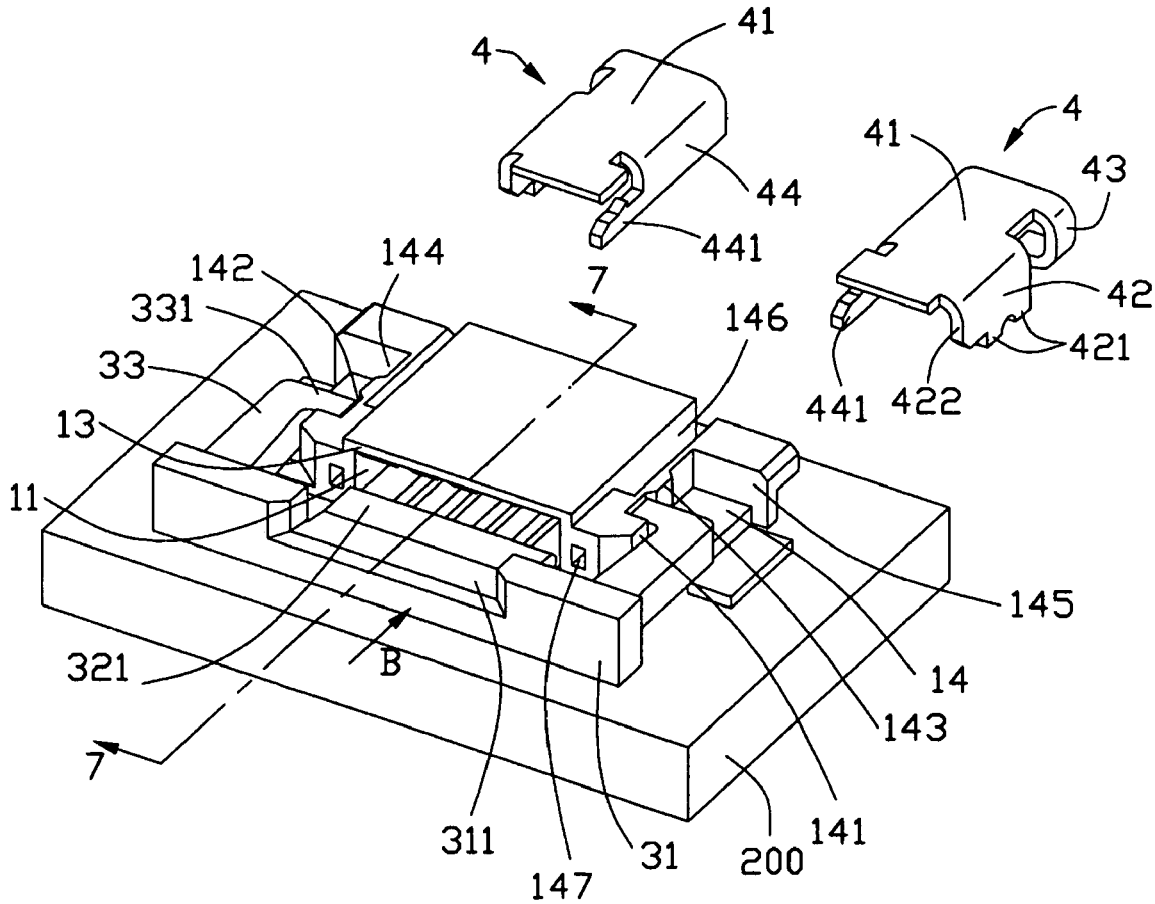
FIG. 6 is still a partly exploded, perspective view of the FPC connector mounted on the PCB shown in FIG. 1, wherein both the two locking ears are detached from the housing, and the actuator is at an open position relative to the housing.

Then the locking ears 4 are assembled to the side portions of the housing 1 to cover the upward and sideward openings of the recesses 14 for preventing the latches 33 of the actuator 3 from upwardly or sidewards moving. As best shown in FIG. 6, each locking ear 4 comprises a top plate 41, a first flange 42 and a retaining ring 43 bent down from one side of the top plate 41, and a second flange 44 bent down from the other side of the top plate 41, wherein the first flange 42 is provided with a pair of grounding legs 421 extending down to be soldered to the PCB 200, the retaining ring 43 is hitched to the back block 145, and the second flange 44 is assembled in a notch 146 defined between the middle portion and the side portion of the housing 1 with a peaked tip 441 thereof inserted into a through hole 147 in the housing 1. Therefore, via the retaining ring 43 and the peaked tip 441, each of the locking ear 4 is firmly retained on the housing 1 to cover the upward and sideward opening of the recess 14 thereby to define a tube-like passageway for guiding the movement of the side latch 33 in the recess 14. The first flange 42 of the locking ear 4 is configured to extend forwards almost to the front face 10 of the housing 1 with a front edge 422 thereof only slightly behind the front face 10. After the locking ears 4 are assembled to the housing 1, the barbed end 331 of the latches 33 is prevented from coming out of the first gap 142 from the course by which it has come or over the front tuber 141 oppositely along the insertion direction B, but is allowed to pass over the middle tuber 143 to reach the second gap 144 along the insertion direction B, since the front tuber 141 is larger in size than the middle tuber 143 and a space between the middle tuber 143 and the first flange 42 is dimensioned larger than a space between the front tuber 141 and the first flange 42.

Then, for receiving the FPC, the actuator 3 is slightly tilted by raising the base 31 to form a slant insertion port for more convenient insertion of the FPC. As the front end of the tongue 32 is of a comb-like shape, when the actuator 3 is tilted, the tips 325 of the tongue 32 remain abutting on the lower wall 12, while the fixed arms 21 of the terminals 2 being received in the cutout 324 of the tongue 32 as if the tips 325 are locked in gaps between fixed arms 21, therefore to prevent the actuator 3 from sidewards moving.

Figure 8:
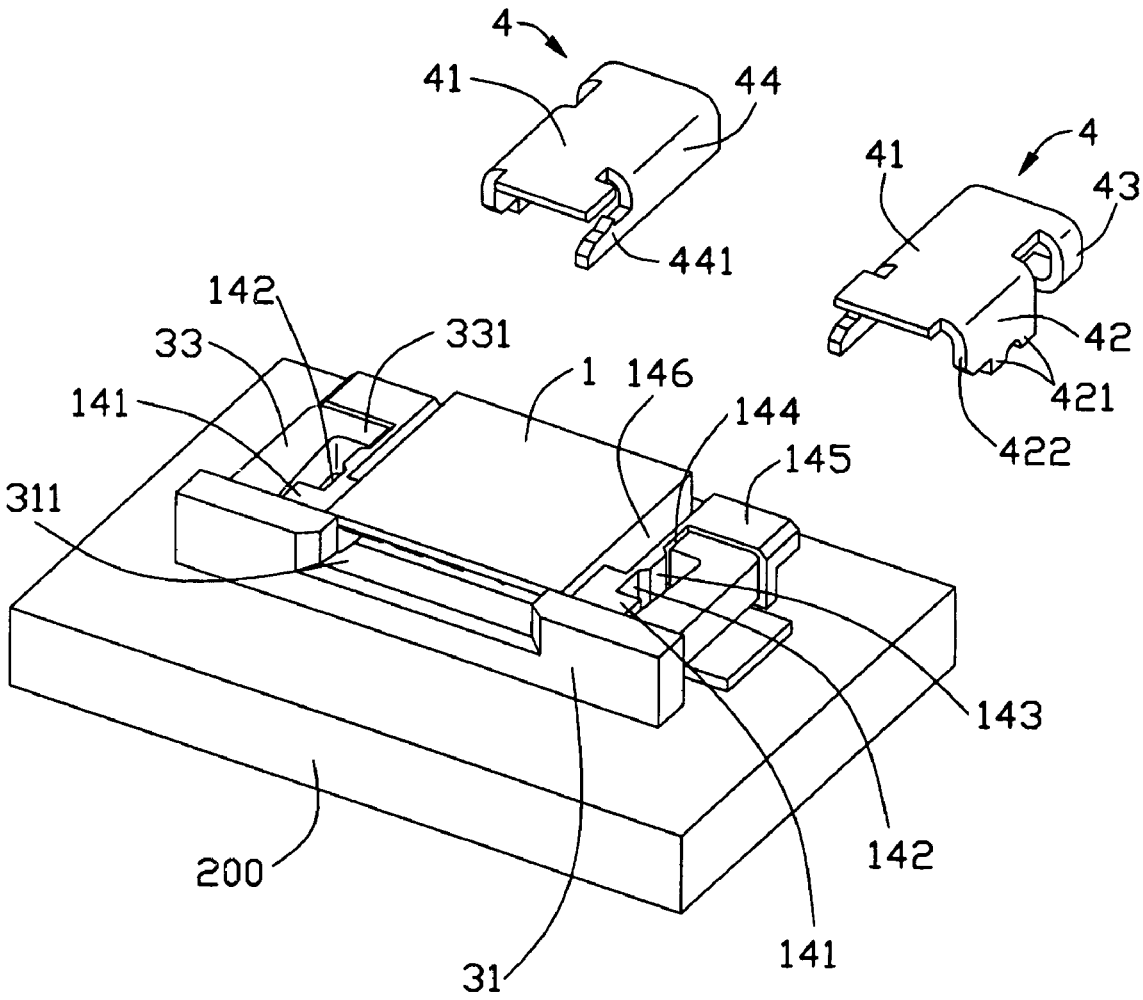
FIG. 8 is a view similar to FIG. 6, but wherein the actuator is at a close position relative to the housing.

Then the FPC is inserted into the cavity 11 along the upper surface 322 of the tongue 32 from the above-mentioned slant insertion port. At last, the actuator 3 is pushed into the cavity 11 to urge the FPC thereon to electrically connect with the resilient arms 22 of the terminals 2, where the actuator 3 is at a closed position relative to the housing 1, as shown in FIG. 8. During this process, the fixed arms 21 of the terminals 2 are fitly received in the slots 324 to guide the insertion of the tongue 32. Meanwhile, the latches 33 of the actuator 3 are forcedly slid from the first gap 142 into the second gap 144 with outer side surfaces thereof always abutting against inner surfaces of the first flanges 42 of the locking ears 4. Thus, the latches 33 will perform a straight and smooth movement, and even if sometimes a push/pull force deflected from the insertion direction B is put to move the actuator 3 by an unintentional and improper operation, a laterally tilting of the actuator 3 can be avoided. It is also noted that because the relative large tuber 141 is located at the front end of the recessed area, the side latch 33 by no means cab be dropped from the guiding passageway.

However, the disclosure is illustrative only, changes may be made in detail, especially in matter of shape, size, and arrangement of parts within the principles of the invention. For example, the complementary interengagement devices of the fixed arm and the slot can be switched with each other to be arranged on the corresponding parts.

What is claimed is:

1. An electrical connector comprising:

an insulative housing defining a cavity opened to a front face thereof and a pair of recessed areas on two side thereof;

a plurality of terminals disposed in the housing and with engagement portions extending into the cavity;

an actuator movably assembled to the housing, said actuator including an elongated base, a tongue extending from a middle section of the base and movably received within the cavity, and a pair of side latches respectively extending from end sections of the base and respectively disposed in the corresponding recessed areas; and a pair of locking ears respectively assembled to an exterior side of the corresponding recessed area of the housing to define a guiding passageway together with the housing for guiding the movement of the side latch in the recessed area, wherein the locking ear comprises a lateral plate shielding both the recessed area and the corresponding side latch in a lateral direction.

2. The electrical connector as described in claim 1, wherein the locking ear comprises a top plate sealing an upward opening of the corresponding recessed area.

3. The electrical connector as described in claim 1, wherein said lateral plate extends substantially parallel to a lateral wall of the housing and has a front edge adjacent to the front face of the housing.

4. The electrical connector as described in claim 1, wherein the side latch has a lateral face for engaging with an inner face of the lateral plate of the locking ear, said lateral face substantially perpendicular to the base of the actuator.

5. An electrical connector comprising:

an insulative housing defining a cavity opened to a front face thereof and a pair of recessed area on two side thereof;

a plurality of terminals disposed in the housing, each of said terminals defining an engagement portion extending into the cavity and a fixed arm opposite to said engagement portion;

an actuator movable assembled to the housing, said actuator including an elongated base, a tongue extending from a middle section of the base and movably received within the cavity, and a pair of side latches respectively extending from end sections of the base and respectively disposed in the corresponding recessed areas; and a pair of exterior abutment walls being discrete from the housing while being formed on exterior sides of the corresponding pair of recessed area of the housing to confine the corresponding side latches from a lateral side.

6. The connector as claimed in claim 5, wherein said exterior abutment walls are provided by a pair of metallic mounting ear with means for mounting the connector to a printed circuit board.

7. The connector as claimed in claim 5, wherein a face of said tongue defines a plurality of slots receiving the corresponding fixed arm.

8. The connector as claimed in claim 5, wherein said side latches slidably directly face and move along the corresponding exterior abutment walls.

9. The connector as claimed in claim 5, wherein said exterior abutment walls defines a pair of guiding passageways together with the housing for guiding the movement of the corresponding side latches in the recessed area.

10. An electrical connector comprising:

an insulative housing defining a mating cavity and a pair of recessed areas on two sides thereof;

a plurality of contacts disposed in the housing with engagement portion;

an actuator including a tongue movably received in the mating cavity along a front-to-back direction, and a pair of side latches movably received in the corresponding pair of recessed areas;

means for guiding movement of said tongue in the mating cavity along the front-to-back direction without tilting; and two exterior abutment walls located on two lateral sides of said recessed areas for guiding movement of said pair of side latches in the corresponding recessed areas along said front-to-back direction without tilting; wherein the housing unitarily defines a tuber at a front face to stop excessive forward movement of the latch so as to assure the latches are moveably received in the corresponding pair of recessed areas respectively without being dropped therefrom.

11. The connector as claimed in claim 10, wherein said abutment wall is discrete from the housing and provided by a metallic mounting ear with means for mounting the connector to a printed circuit board, and wherein the metallic mounting ear has a top plate confining the side latch from a top side.

12. The connector as claimed in claim 10, wherein said first means includes a plurality of projections along said front-to-back direction and a plurality of slots along said front-to-back direction.

13. The connector as claimed in claim 12, wherein said projections are provided by fixed arms of the contacts, and said slots are formed in the tongue.

* * * * *